US007007804B1

(12) United States Patent
Witherspoon, Jr.

(10) Patent No.: US 7,007,804 B1
(45) Date of Patent: Mar. 7, 2006

(54) GAME BALL BAG SYSTEM

(76) Inventor: Frank Witherspoon, Jr., 9093 Plumegrass St., Carona, CA (US) 92883

( * ) Notice: Subject to any disclaimer, the term of this patent is extended or adjusted under 35 U.S.C. 154(b) by 0 days.

(21) Appl. No.: 10/160,964

(22) Filed: Jun. 1, 2002

Related U.S. Application Data

(60) Provisional application No. 60/298,032, filed on Jun. 12, 2001.

(51) Int. Cl.
*B65D 85/00* (2006.01)

(52) U.S. Cl. ..... 206/579; 70/64; 206/1.5; 206/315.9; 206/807; 224/919

(58) Field of Classification Search ..... 70/63–68; 206/1.5, 315.1, 315.9, 579, 807; 224/919
See application file for complete search history.

(56) References Cited

U.S. PATENT DOCUMENTS

| | | | | | |
|---|---|---|---|---|---|
| 1,927,492 | A | * | 9/1933 | Halpin | 206/315.91 |
| 4,031,724 | A | * | 6/1977 | Atkinson | 70/68 |
| 4,510,982 | A | * | 4/1985 | Sangroni | 224/657 |
| 5,085,320 | A | * | 2/1992 | Scott | 206/315.9 |
| D373,472 | S | * | 9/1996 | Eaton et al. | D3/257 |
| 5,927,581 | A | * | 7/1999 | Reddy et al. | 224/578 |
| 6,095,390 | A | * | 8/2000 | Bogle | 224/664 |
| 6,612,946 | B1 | * | 9/2003 | McClain | 473/569 |

* cited by examiner

*Primary Examiner*—Jim Foster

(57) ABSTRACT

A game ball bag that includes a compartment adapted for holding a large, round object such as a basketball and which includes a lockable strap assembly for securing the bag to an immovable structure such as a park bench, chain link fence, tree or similar structure.

1 Claim, 1 Drawing Sheet

12
10

60
12
14
50
10

42
40
48
16
12
22
26
36
24
44
24
30
20
10

GAME BALL BAG SYSTEM

This application claims the benefit of Provisional application Ser. No. 60/298,032, filed Jun. 12, 2001.

TECHNICAL FIELD

The present invention relates to sporting ball bags and more particularly to a game ball bag system that includes a ball bag portion having a cavity sized and adapted to receive and hold a ball such as a basketball, soccer ball, or the like; the ball bag portion including a zippered access opening having a lockable zipper tab in combination with a lockable strap element that attaches to a latch extending from the closed zipper tab location in a manner such that the bag may be locked to a pole or the like, by looping the strap around the pole and engaging the locking end of the strap with the latch and zipper tab closure; the exterior surface of the ball bag portion including a water bottle pocket with a sealable closure on one side thereof and a second outside pocket with a sealable closure for holding various items; if desired, an interior pocket may be provided for holding an item such as keys, cell phone, wallet or other items which would warrant extra protection from theft.

BACKGROUND OF INVENTION

It is often bothersome to carry a sporting ball such as a basketball or soccer ball from one location to another because the ball is bulking and can roll away or be stolen easily. It would be desirable, therefore, to have a game ball bag with included a compartment specifically adapted for holding a large round object and which included a locking strap for securing the bag in a locked configuration to an unmoveable structure such as a park bench, chain link fence, tree, or the like.

SUMMARY OF INVENTION

It is thus an object of the invention to provide a game ball bag that includes a ball bag portion having a cavity sized and adapted to receive and hold a ball such as a basketball, soccer ball, or the like; the ball bag portion including a zippered access opening having a lockable zipper tab in combination with a lockable strap element that attaches to a latch extending from the closed zipper tab location in a manner such that the bag may be locked to a pole or the like by looping the strap around the pole and engaging the locking end of the strap with the latch and zipper tab closure; the exterior surface of the ball bag portion including a water bottle pocket with a sealable closure on one side thereof and a second outside pocket with a sealable closure for holding various items; if desired, an interior pocket may be provided for holding an item such as keys, cell phone, wallet or other items which would warrant extra protection from theft.

Accordingly, a game ball bag is provided. The game ball bag includes a ball bag portion having a cavity sized and adapted to receive and hold a ball such as a basketball, soccer ball, or the like; the ball bag portion including a zippered access opening having a lockable zipper tab in combination with a lockable strap element that attaches to a latch extending from the closed zipper tab location in a manner such that the bag may be locked to a pole or the like by looping the strap around the pole and engaging the locking end of the strap with the latch and zipper tab closure; the exterior surface of the ball bag portion including a water bottle pocket with a sealable closure on one side thereof and a second outside pocket with a sealable closure for holding various items; if desired, an interior pocket may be provided for holding an item such as keys, cell phone, wallet or other items which would warrant extra protection from theft.

BRIEF DESCRIPTION OF DRAWINGS

For a further understanding of the nature and objects of the present invention, reference should be had to the following detailed description, taken in conjunction with the accompanying drawings, in which like elements are given the same or analogous reference numbers and wherein.

EXEMPLARY EMBODIMENTS

Figure 3:
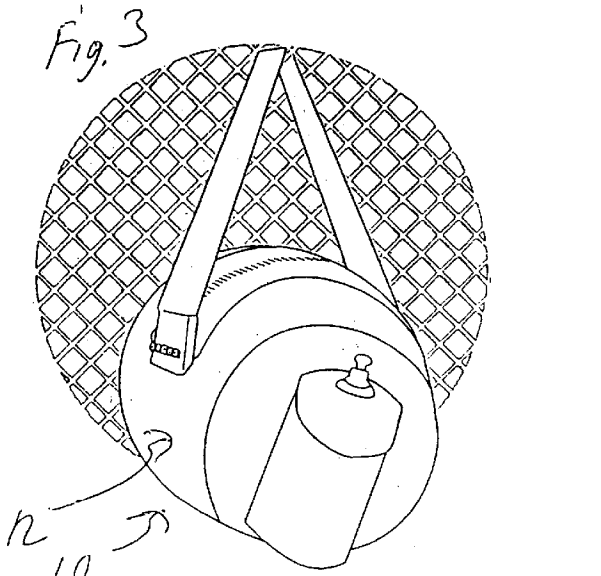
FIG. 3 shows the game ball bag secured to a chain link fence using the strap and combination lock.
Figure 2:
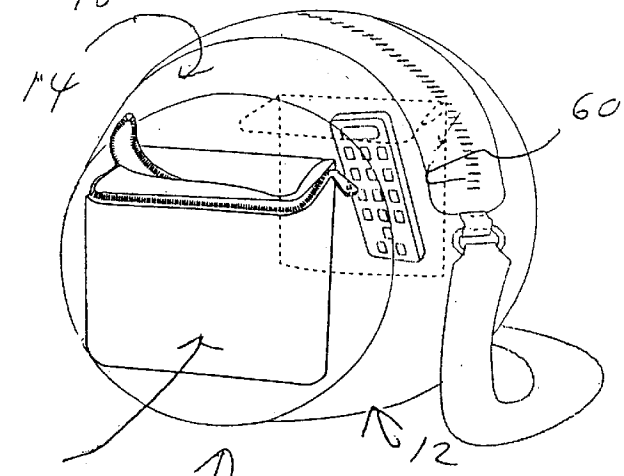
FIG. 2 is a second perspective view showing the opposite side with the outside pocket for holding various other items.
Figure 1:
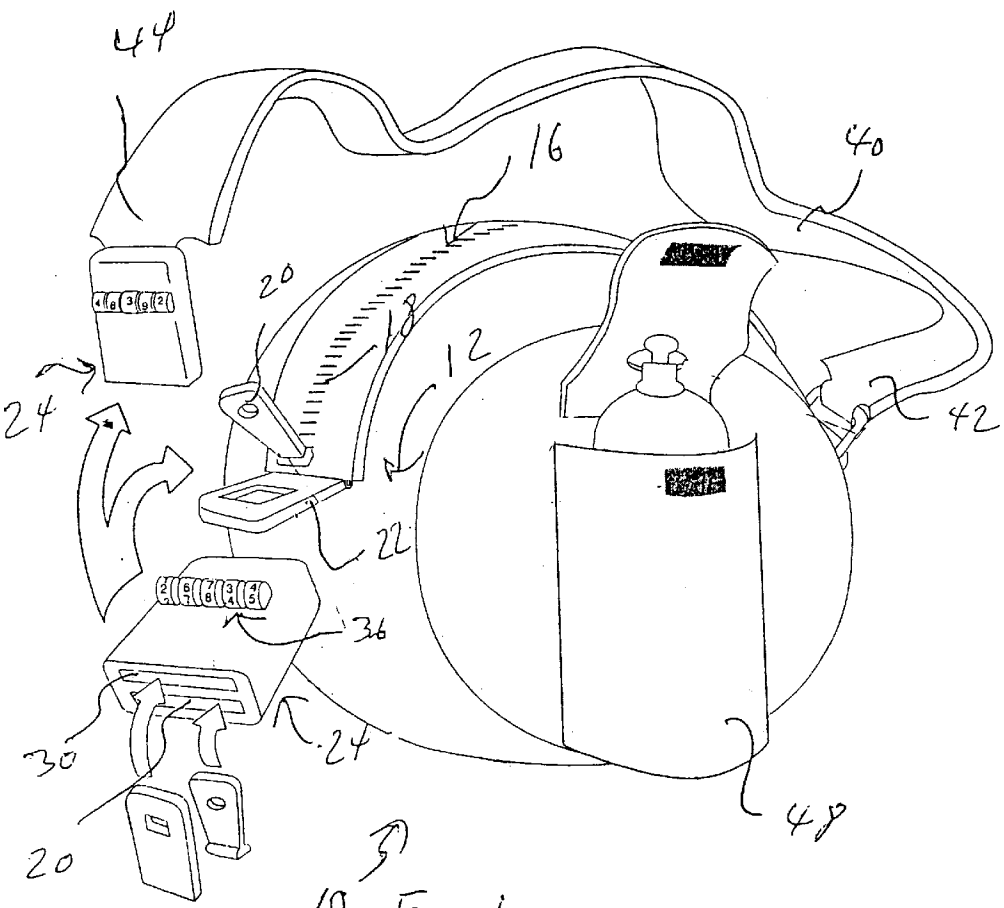
FIG. 1 is a perspective view of an exemplary embodiment of the game ball bag showing the water bottle pocket on the exterior thereof.

FIGS. 1 through 3 show various aspects of an exemplary embodiment of the game ball bag of the present invention generally designated 10. Game ball bag 10 includes a ball bag portion generally designated 12 that has an interior compartment generally designated 14 that is adapted to hold a large round object such as a basketball, soccer ball or the like and which is accessible through a zippered access opening generally designated 16 having a zipper 18 provided with a pull tab 20 that is positioned adjacent to a latch portion 22 of a combination locking mechanism 24 when the zipper 18 is in the closed position. Locking mechanism 24 includes a latch receiving cavity 30 and a zipper pull tab receiving cavity 20 which are locked therein when the numerical combination dials 36 of locking mechanism 24 are moved from the unlocked combination.

Ball bag portion 12 also includes a strap 40 that is permanently secured at a first end 42 to bag portion 12 and is secured at the second end 44 to lock portion 24. A water bottle pocket 48 is provided on one side of the ball bag portion 12, a zippered outside pocket is provided on an opposite side of ball bag portion 12 and an interior pocket 60 is provided within ball bag portion cavity 14.

It can be seen from the preceding description that a game ball bag has been provided.

It is noted that the embodiment of the game ball bag described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A game ball bag comprising:

a ball bag portion having a cavity sized and adapted to receive and hold a ball;

the ball bag portion including a zippered access opening having a lockable zipper tab in combination with a lockable strap element that attaches to a latch extending from the closed zipper tab location in a manner such that the bag may be locked to a pole or the like by looping the strap around the pole and engaging the locking end of the strap with the latch and zipper tab closure;

the exterior surface of the ball bag portion including a water bottle pocket with, a sealable closure on one side thereof and a second outside pocket with a sealable closure for holding various items;

an interior pocket is provided within the cavity for holding small items which warrant extra protection from theft.

* * * * *